US005886630A

United States Patent [19]

Menoud

[11] Patent Number: 5,886,630

[45] Date of Patent: Mar. 23, 1999

[54] ALARM AND MONITORING DEVICE FOR THE PRESUMPTION OF BODIES IN DANGER IN A SWIMMING POOL

[76] Inventor: Edouard Menoud, Grand-Voivet 28 CH-1228-Plan-Los-Duetes, Geneva, Switzerland

[21] Appl. No.: 781,946

[22] Filed: Dec. 6, 1996

[30] Foreign Application Priority Data

Jun. 9, 1994 [CH] Switzerland ..... 01847/94

[51] Int. Cl.[6] ..... G08B 21/00

[52] U.S. Cl. ..... 340/540; 340/566; 367/153

[58] Field of Search ..... 340/540, 555, 340/566, 573, 604; 367/131, 136, 153

[56] References Cited

U.S. PATENT DOCUMENTS

| | | | |
|---|---|---|---|
| 3,370,284 | 2/1968 | Bagno | 340/258 |
| 4,604,610 | 8/1986 | Baker et al. | 340/566 |
| 4,932,009 | 6/1990 | Lynch | 367/153 |
| 5,043,705 | 8/1991 | Rooz et al. | 340/573 |
| 5,121,104 | 6/1992 | Nelson et al. | 340/566 |
| 5,142,508 | 8/1992 | Mitchell et al. | 340/566 |
| 5,146,208 | 9/1992 | Parra | 340/566 |
| 5,162,777 | 11/1992 | Kolbatz | 340/566 |
| 5,369,623 | 11/1994 | Zerangue | 340/540 |

FOREIGN PATENT DOCUMENTS

| | | |
|---|---|---|
| 0402829 | 6/1990 | European Pat. Off. . |
| 2254215 | 9/1992 | United Kingdom . |
| 90/03624 | 4/1990 | WIPO . |

*Primary Examiner*—Brent A. Swarthout
*Assistant Examiner*—John Tweel, Jr.
*Attorney, Agent, or Firm*—Henderson & Sturm

[57] ABSTRACT

The invention relates to a device for monitoring the absence of motionless bodies in a swimming pool. Two cameras (1) provide for the permanent imaging of the bottom of the swimming pool. These images are first digitized and then processed by a computer. The superimposition of the two information permits analysis of substantially the entire the surface of the swimming pool in order to determine if a portion is masked by an obstacle. When such obstacle is detected, the duration of the presence of each masked pixel is analyzed. After a certain time delay, and for a minimum number of neighboring pixels, an alarm is generated.

14 Claims, 6 Drawing Sheets

+12V
R9
100K
Q1
2N2222
3
2
1
R8
10K
11
U3D
4093
12
13
C7
100n
D7
IN4148
R7
180R
10
U3C
4093
8
9
R6
100K
D4
IN4148
D3
1N4148
D6
1N4148
D5
IN4148
C5
100n
R4
10K
C6
100n
R5
10K
10

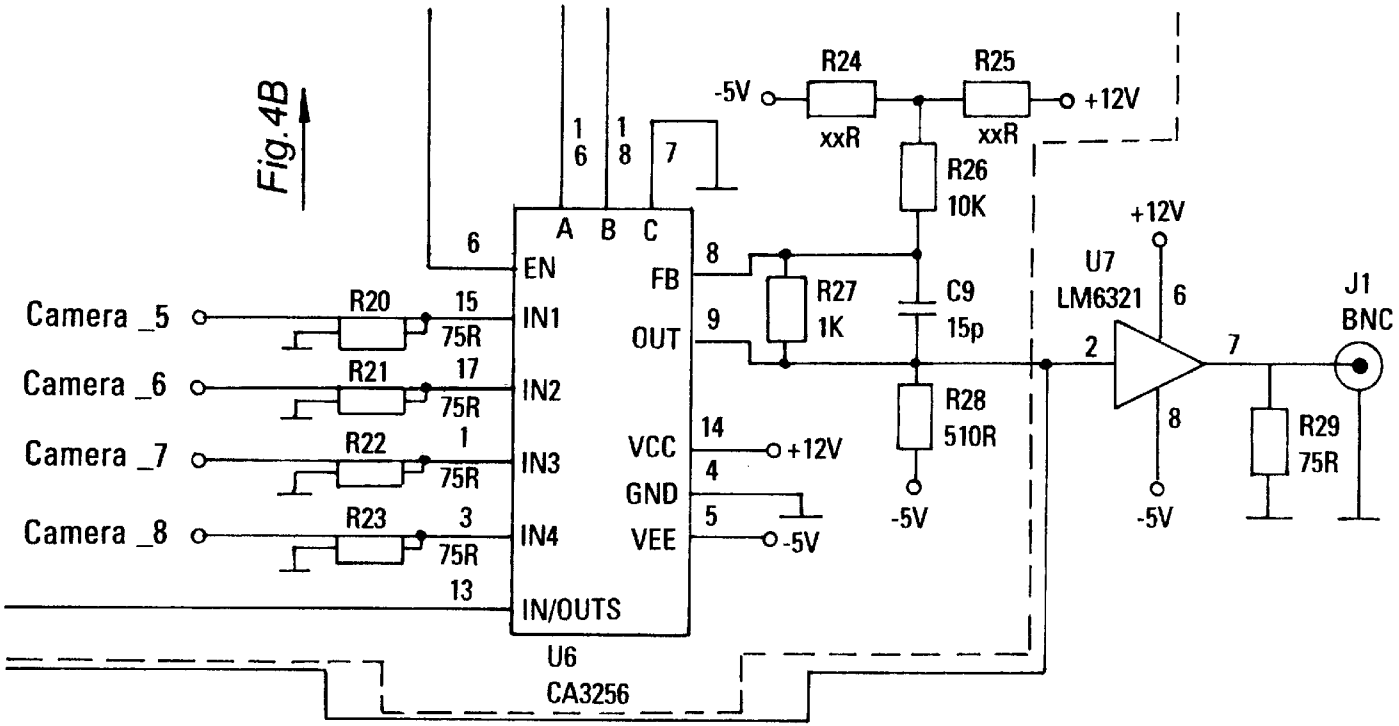
Fig. 4B
Fig. 4C
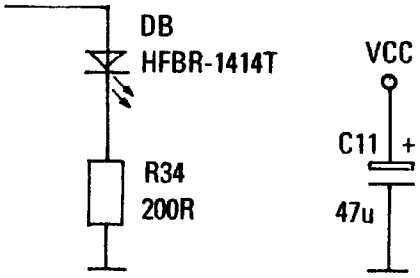
Fig. 4D

ALARM AND MONITORING DEVICE FOR THE PRESUMPTION OF BODIES IN DANGER IN A SWIMMING POOL

CROSS-REFERENCE TO RELATED APPLICATIONS

This application is a Continuation-in-Part of International Application Serial No PCT/IB95/00426, filed Jun. 2, 1995 (claiming priority of Swiss Patent Application No 01847/94, filed Jun. 9, 1994), the disclosure of which is hereby incorporated by reference in its entirety.

AUTHORIZATION PURSUANT TO 37 C.F.R. §1.71 (d) (e)

A portion of the disclosure of this patent document, including appendices, may contain material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

The present invention relates to a non-constraining device for monitoring the absence of endangered bodies in a swimming pool. There is a presumption and triggering of an alert when monitoring this absence is disturbed.

When a person suffers from an indisposition in a swimming pool as a result of a major problem such as hydrocution, a heart attack, exhaustion etc., the natural reflex of the rachidian bulb causes him to swallow a volume of water the effect of which is to accelerate the body's movement down to the bottom of the swimming pool. Such events can happen when a swimming pool attendant is on duty but could be momentainly absent or simply unable to see the person in difficulty because of reflections of the sun's rays on the surface of the water, or because of an unfavorable angle of vision or simply due to inattention. Likewise, other bathers may be in the proximity without being aware of the problem.

The reaction time is important and each few seconds before an alert is given can be decisive for the person in danger.

Several solutions have already been proposed to resolve this problem. However, the different known equipments are based essentially on the use of sonar or radio waves or even laser beams and are relatively ill-adapted to use in public swimming pools due to difficulties related principally to the properties of the water or reflective effects against the walls.

FIG. 2 presents the coefficients of absorption of electromagnetic waves measured in pure water. On the abscissa, is the wavelength wherein the zone of visibility is in the region of 0.35 to 0.8 micrometers. On the ordinate is the attenuation per centimeter of water traversed. By way of indication, the attenuation over 10 m of water at a wavelength of 0.8 microns, at the border of visible infra red, is 0.000043. Moreover, low attenuation coefficients corresponding to the blue-violet zone are substantially altered by the water's turbidity when many bathers are swimming. By way of example, when a swimming pool is observed through portholes while the pool is densely occupied, it may be difficult or even impossible to distinguish a bather located at 25 or 30 m.

U.S. Pat. No. 5,043,705 is written in very general terms and is based on the measurement of the distance between the detector and a possible obstacle to ascertain its presence. It mentions various components including a sonar adequately adapted to detect a body placed between the sonar and a wall, but which would encounter enormous difficulties to detect a body situated very close to a wall, the latter creating numerous reflections. The same applies to detection by radio frequency due to problematic propagation in water. This patent also mentions lasers without however specifying the mode of operation. Moreover, it enumerates general methods of eliminating noise because its aim is the identification of the immobile object.

BRIEF SUMMARY OF THE INVENTION

It is an object of the invention to provide a monitoring system based on the permanent detection of a fixed image or pattern having known mathematical features, and the simple absence of which enables the setting off of an alarm, whatever may be the contour of the obstacle.

The present invention is based on the certitude of detecting the absence of an obstacle and, by the use of the principle of luminous barriers, makes use of data processing and in particular so-called image processing algorithms and proposes solutions for automatically monitoring the swimming pool with a view to reducing the lapse of time before an alert is given and improving traditional monitoring.

The invention relates to a swimming pool monitoring system comprising at least one device for monitoring the absence of bodies in danger in a swimming pool, constituted of a means for observing critical zones, said observing means being connected to a computer processing the data obtained and able to distinguish the absence of submerged immobile bodies from other bodies and to signal danger when the duration of immobility of an observed body in a critical zone has exceeded a given threshold. Said means for observing these critical zones operates at visible wavelengths and comprises emitters and receivers arranged in such a manner that each observed zone is situated in a volume adjacent to and parallel to the bottom of the swimming pool.

According to the invention, such a system is improved by further comprising at least one stationary pattern constituted of or adapted to be applied to at least one portion of the swimming pool wall adjacent said critical zones, said system being arranged to monitor said absence of bodies in danger by the permanent detection of said pattern, to signal danger by detection of the temporary (but not transcient) obstruction of said permanently detected pattern.

The pattern can for example be composed of tiles of contrasting colors, or by applying acrylic or polyurethane paint on the lower part of the swimming pool walls. The pattern is made up of alternating contrasting zones, such as squares in a chequer pattern or vertical stripes.

The principle of the invention resides in monitoring only the bottom parts of the swimming pool's walls, covered with the alternating pattern. Recognition of this pattern, based on digital analysis of the image, serves as the basis of a continuous measurement of the visibility in the swimming pool to permanently determine if the pattern on the facing wall is completely visible. Recognition of this pattern is made by using an algorithm, for instance derived from optical analysis (Fourier analysis).

The system comprises means for detecting and signaling whether light rays can or cannot pass through a zone of the swimming pool to be observed, either due to the presence of a body or for any other reason affecting visibility.

For example, said means for detecting the capacity of light rays to pass through the zones to be observed comprises means for detecting the limits of said zones to be observed which can be in the form of a multiplicity of light barriers having elements placed on either side of the zones to be observed, or reflection barriers having reflectors placed on the side opposite to that with the receivers.

The system also comprises light-signal emitters constituted of light projectors, or luminous strips located on the periphery of the swimming pool, or the pool can be illuminated by daylight. Light-barrier receivers can be concentrated at various points and can be provided with mechanical or electrical scanning means arranged in such a manner as to enable them to observe the desired limits of said zones. Light receivers can be constituted of video cameras associated with software adapted to process selected limiting zones.

The system can include means for providing various images taken at different angles which are superimposed to provide a composite image corresponding to a plan view of the swimming pool wherein bodies on the bottom appear and which serves as basis for the processing of the absence or the presence of immersed immobile bodies.

Additionally, the system can include a device for monitoring correct functioning of the basic equipment which superimposes on the emitted rays a periodic modification of a part of these rays, and a device for controlling the result of this modification which signals any deficiency or non-perception of said modification by the basic equipment.

In addition to detection means placed under the surface of the water, the system can include further detection means such as cameras placed out-of the water to enable an increase of the data contributing to determining danger.

Several cameras can be installed to scan different areas of the swimming pool's walls. Generally, one camera is needed for about 20–30 meters of pool wall. The cameras can be located adjacent the pool's walls or centrally, enclosed in a transparent dome or the like. A central computer can be programmed to examine the image of each camera for a fixed time, about 0.5 seconds, then examine the image of the next camera. For a pool equipped with eight cameras, this means a cycle of about 4 seconds (8×0.5 seconds).

An alarm can be set off if a portion of the image of the permanently observed pattern, corresponding to a minimum part of the observed pattern is disturbed for a certain minimum time, say 20–30 seconds, which corresponds to about 4 to 7.5 cycles. The alarm can be a sound attracting the attention of the swimming pool attendant, and can be completed by a visual signal indicating the zone of the pool where the obstruction has occurred.

By observation of the contrasting zones of the pattern on the swimming pool wall—instead of directly attempting to identify swimmers as in the prior art—the system of the invention avoids setting off of alarm unwantedly due for example to the sun's rays or shadows projected by swimmers or by waves on the surface of the water.

However, in case of extreme conditions such as high turbidity of the water or insufficient illumination for example due to a storm or due to blinding of a camera by sunlight, the system can be automatically set out of service and a signal provided to the attendants that the zone in question is no longer being monitored.

The invention thus relates to a device for monitoring the absence of motionless bodies in a swimming pool. Two or more cameras provide for the permanent imaging of the bottom of the swimming pool. These images are first digitized and then processed by a computer. The superimposition of the two information permits to analyze all the surface of the swimming pool in order to determine if a portion is masked by an obstacle. When such obstacle is detected, the duration of the presence of each masked pixel is analyzed. After a certain time delay, and for a minimum number of neighboring pixels, an alarm is generated.

Further features of the invention are set out in the dependent claims.

BRIEF DESCRIPTION OF THE SEVERAL VIEWS OF THE DRAWINGS

Further features of the invention will be apparent from the following description given by way of non-limiting example and with reference to the accompanying drawings which show.

DETAILED DESCRIPTION OF THE INVENTION

Figure 1:
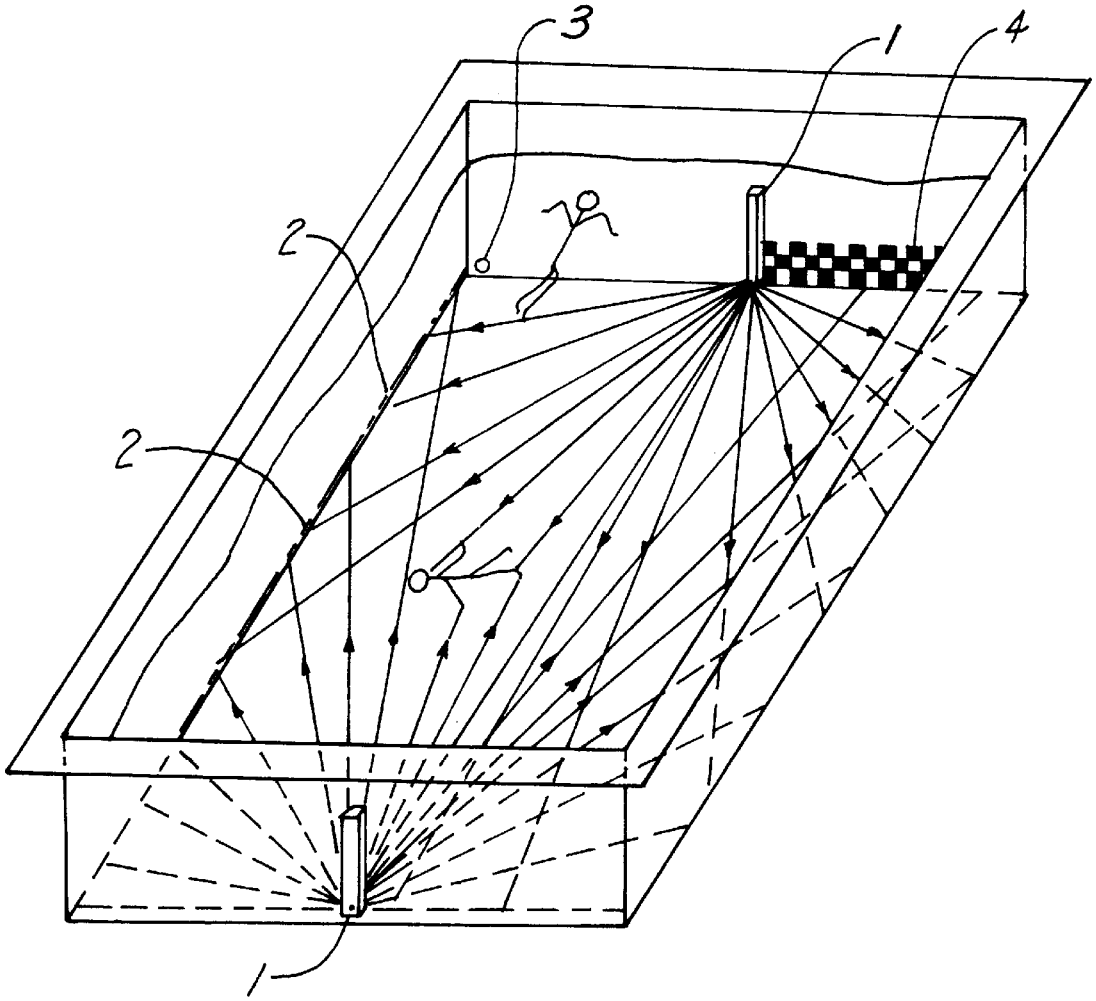
FIG. 1. A schematic perspective view of a swimming pool equipped with two cameras scanning the space immediately above the pool bottom.
Figure 2:
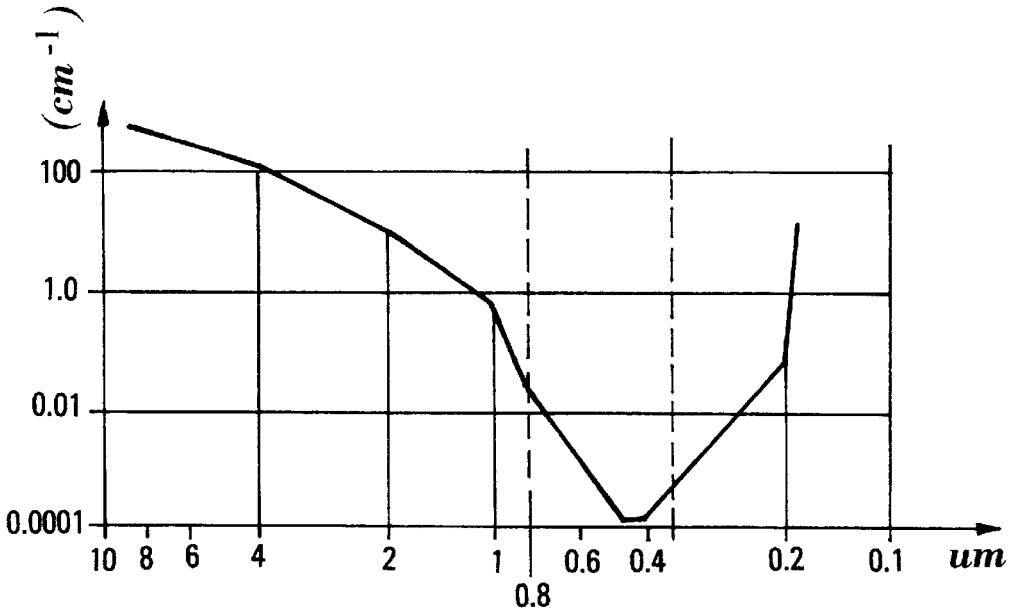
FIG. 2. A curve showing the absorption of radiation in water.

FIG. 1 shows a swimming pool equipped with two cameras 1, each scanning the surface situated at the bottom of the pool walls. The observed surfaces are marked with patterns enabling working zones to be defined located in the field of view of the cameras with traversing vision, by scanning movement of the cameras. The patterns can be in the form of a horizontal line 2 or a succession of contrasting zones 2 of narrow width, or greater width such as represented by the chequer pattern 4 enabling an increased monitored volume, or even an array of isolated patterns 3. The non-detection of these patterns by the scanning cameras 1 results in setting off a corresponding alarm corresponding to the presence of an obstacle, or placing the monitoring system off circuit.

The data from the cameras 1 are supplied to image processing software. At least two types of processing can be implemented. The first one is especially well adapted for deep swimming pools, i.e. where bathers feet only occasionally touch the bottom; the second type of processing is better adapted to shallow pools.

In the first case, it is sufficient to observe the mobility and duration of objects which obstruct detection of the pattern, corresponding to the presence of a body on the pool bottom, and to set off an alarm in response to danger criteria.

In both cases, the algorithm of the image-processing software is based on four basic phases: attenuation of the background noise, pre-filtration of insignificant harmonics followed by subtraction of the background noise, contrast equalization, and the spectral selection of significant harmonics. The latter phase is divided into two steps: an initial step which comprises selecting the absolute value of all amplitudes whose spatial frequency surrounds that resulting from an alternating arrangement of tiles (i.e. the pattern), followed by a step of classifying the selected amplitudes into a histogram from whose shape it can easily be determined if the signal is a periodic one or merely noise.

The sequence of the maximum values of these histograms from the detection algorithm is then compared to a reference which is kept up to date for each camera. For each point, where a difference exceeding a threshold value is detected, the program takes note of a presence which is materialized by an image-mark which is transmitted to a central image-processing unit. When a presence is considered to be certain, i.e. when no non-significant incidents are detected, this central image-processing unit measures the persistence of each image and compares this duration with a fixed duration associated with detection. When the persistence of an image-mark is greater than the detection duration, an alarm is set off.

In the second type of processing, better adapted to shallow pools, the same analysis method is used but in addition the planar image of the pool bottom must be reconstituted as a function of information received from various cameras by proceeding with the intersection of sets representing bodies (somewhat in the manner of a scanner). From this image, it is possible to obtain supplementary information corresponding to the pool bottom surface and which is a function of the dimension of bodies. This proposed processing consists of associating each of the pixels representing a part of a body with a new variable called "immobility". The immobility of the pixel is a function of the number of cycles corresponding to the observation of said pixel in the activated state. The latter active state corresponds to the presence of a body in danger. Immobility increases linearly or non linearly as a function of the number of cycles during which the pixel is activated and decreases in non-linear fashion when it is observed in the inactivated state, thus creating a remanence effect. An alarm can be generated when a number of neighboring pixels are found to have a high immobility corresponding to a volume-time relationship that can represent a person in danger.

As shown in FIG. 1 two cameras 1 are situated at opposite ends of a pool. Each camera has an approximately 180° field of vision extending over the lower parts of the pool's walls provided with the alternating pattern 2, 3 or 4. It can be seen that these cameras each view the opposite end of the pool, in addition to both cameras observing the side walls from different angles. As illustrated, an immobile body in the pool bottom will obstruct both camera's view of the patterns 2, 3 or 4, setting off an alarm and providing an indication of the location of the body.

Alternatively, several cameras can be located centrally in the pool, in a transparent dome, for example 4 cameras viewing the four walls, or 8 cameras, each viewing a selected part of the alternating pattern on the bottom of the walls.

The number of cameras should be adapted as a function of the size of the swimming pools or the desire to reduce the effects due to the obstruction of one or more cameras by one another.

Additionally, one or several cameras can be placed above water level, which also enables the effects of obstruction to be controlled.

Figure 4A:
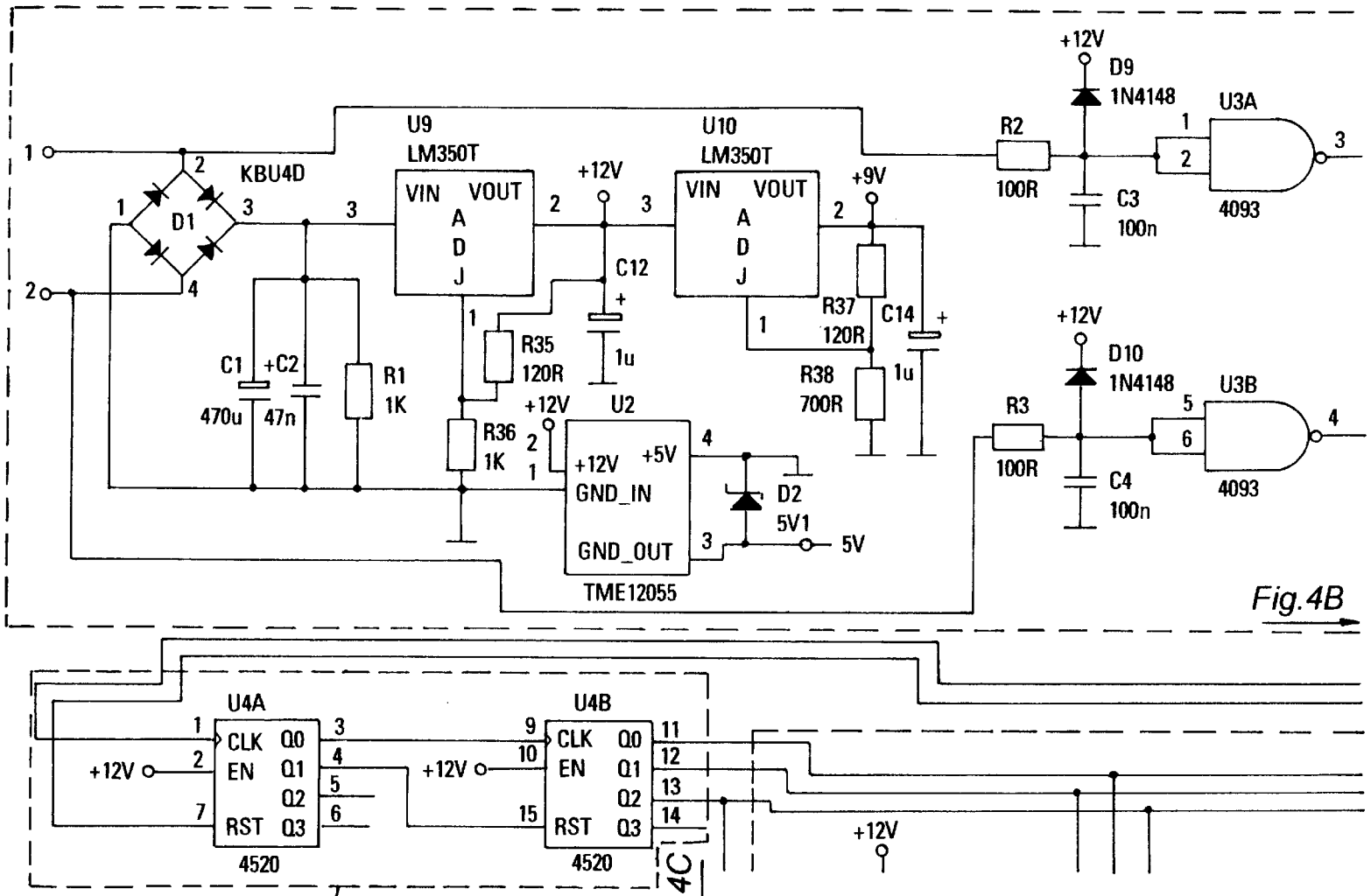
FIG. 4. A circuit diagram of the video commutation circuit of a system including eight cameras is shown as quadrants identified as FIG. 4A, FIG. 4B, FIG. 4C and FIG. 4D.
Figures 4A, 4B, 4D:
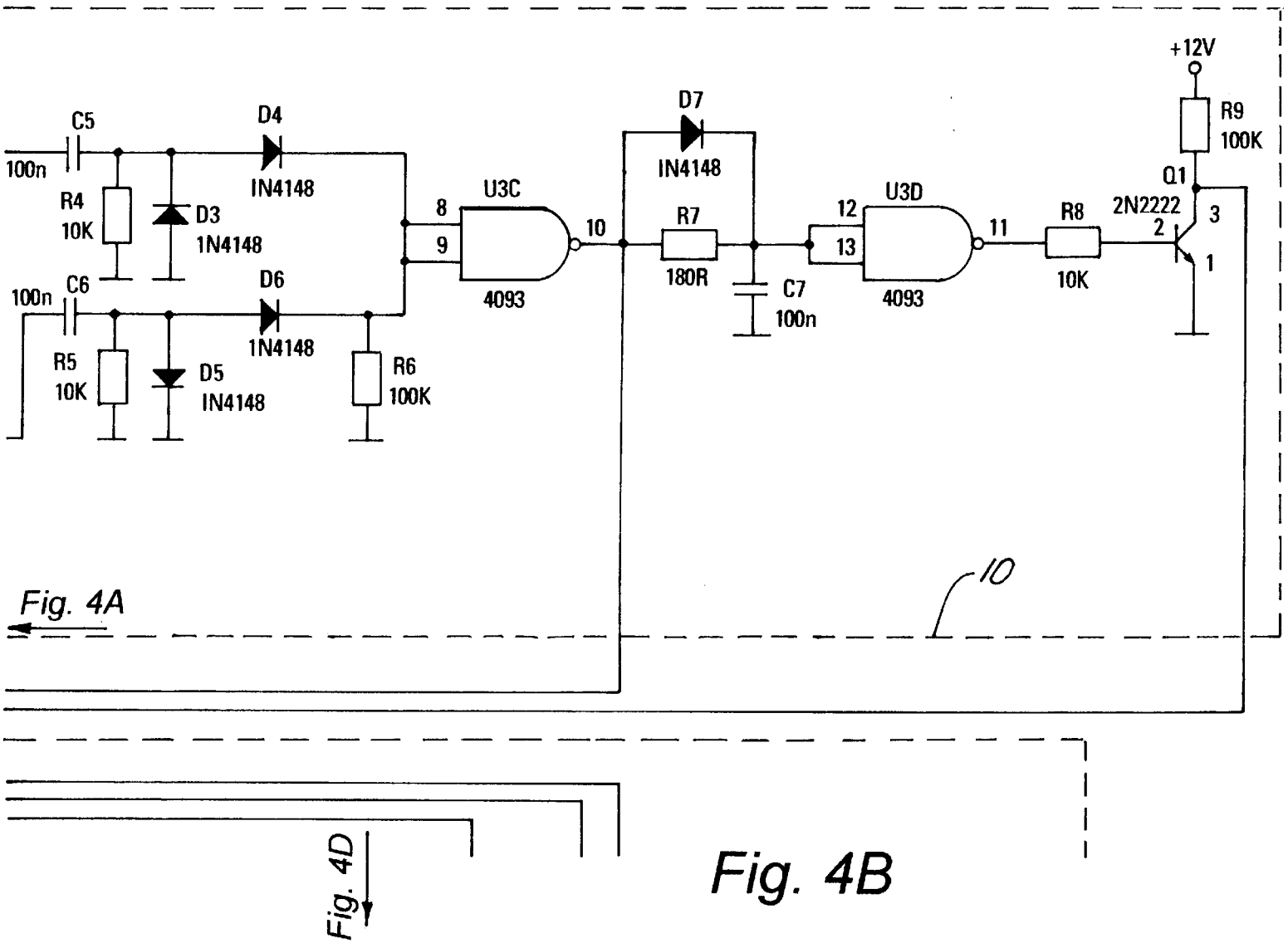
Figure 4C:
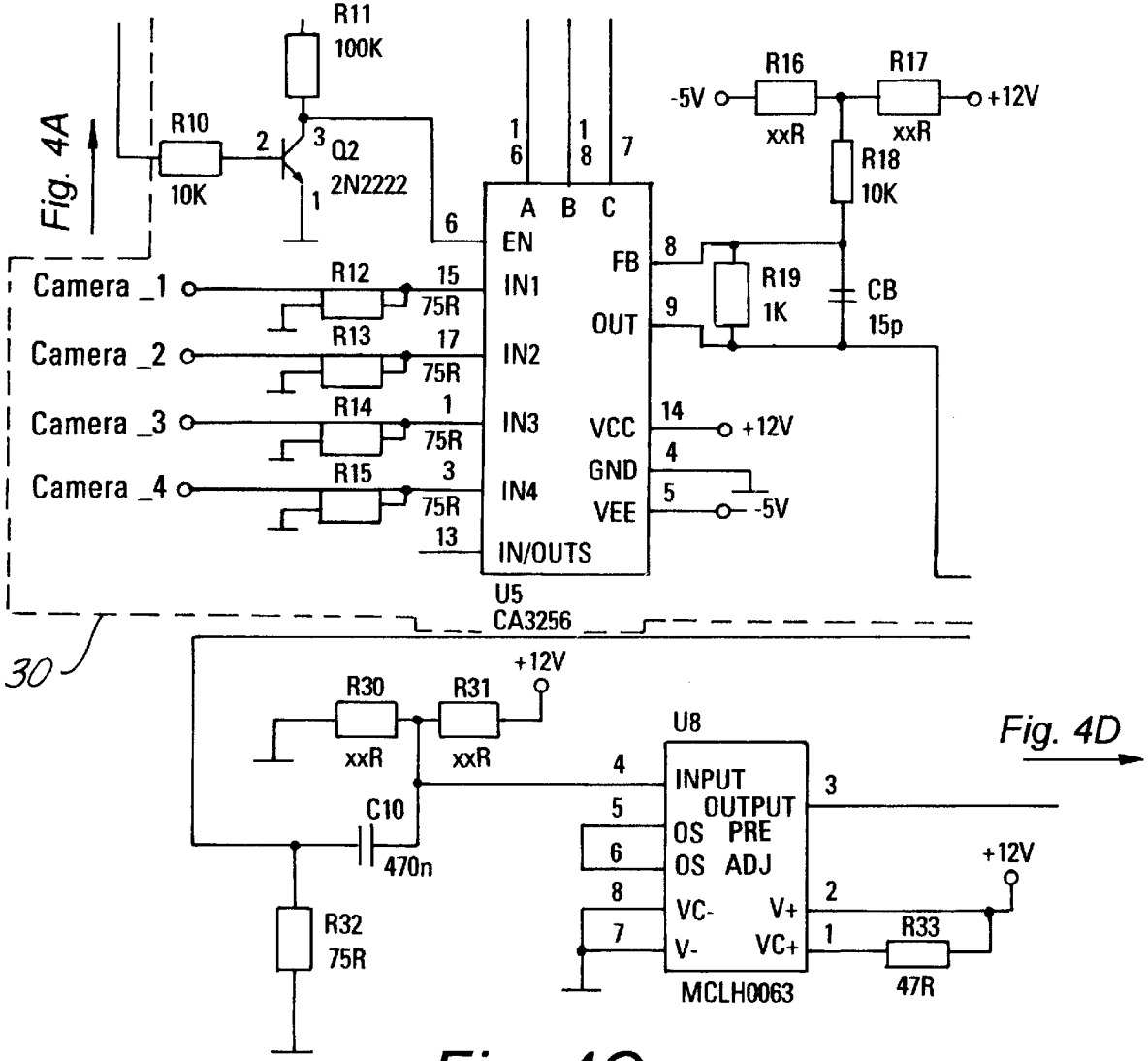

FIG. 4 shows the circuit diagram of the video commutation of the system according to the invention for processing the images supplied by several cameras, cameras which are installed in a swimming pool, in this example eight cameras. This Figure shows a commutation and synchronization module (or unit) 10 with a H-shaped bridge, a counting module 20 and a camera control module 30.

The input of the H-shaped bridge of the commutation and synchronization module 10 is connected to the output of an emitter module, not shown. This emitter module supplies a.c. to the input of an H-shaped bridge, in the form of simple pulses to cause commutation of one camera to the next, and in the form of multiple pulses (for example triple pulses) to cause resynchronization to the first camera.

The output of the commutation and synchronization module 10 is connected to the counting module 20 which generates a clock signal supplying the camera central module 30.

In this example, this camera control module 30 comprises two integrated circuits in series, to each of which are respectively connected four cameras. Each clock signal causes either switching to the next camera, or resynchronization to the first camera, as a function of the signal supplied by the emitter module. Of course, this module 30 could equally well comprise a single integrated circuit to which the cameras are connected, providing this circuit has a sufficient number of input terminals.

The images of each camera are then delivered via the output of this camera control module 30 to the computer that processes the images-marks for visualization and setting off of an alarm when needed.

A simplified algorithm and the use of a single camera, possibly complemented by mirrors or reflectors, may be sufficient to monitor a medium-sized swimming pool such as a hotel or private pool.

Figure 3:
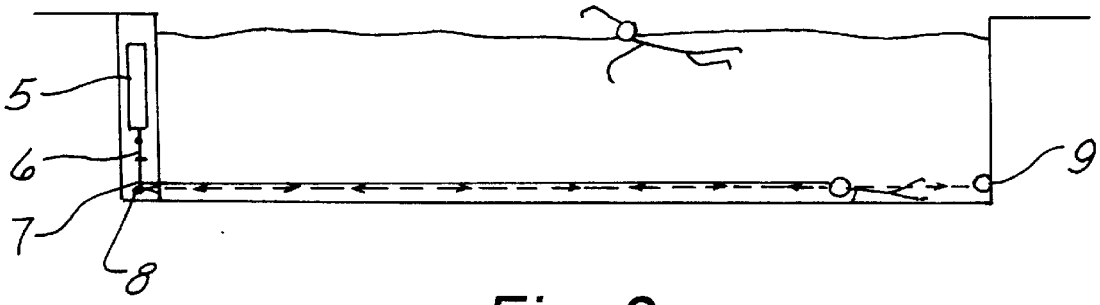
FIG. 3. A schematic side view along a swimming pool equipped with a scanning device incorporating a collimator-type light emitter.

FIG. 3 involves the use of a light source 5. The emitted ray 6 is reflected by a mirror 7 itself servo-controlled by a motor 8. The ray scans the swimming pool bottom as a function of rotation of the motor and is reflected back by means of a reflector 9 to the mirror 7 and is received by a receiver situated beside the source 5.

Moreover, the light signals can be modulated in order to differentiate them from ambient signals (noise).

I claim:

1. A swimming pool monitoring system, comprising at least one device for monitoring the absence of bodies in danger in a swimming pool, constituted of a means for observing critical zones, said observing means being connected to a computer processing the data obtained and able to distinguish the absence of submerged immobile bodies from other bodies and to signal danger when the duration of immobility of an observed body in a critical zone has exceeded a given threshold, said means for observing said critical zones operating at visible wavelengths and comprising emitters and receivers arranged in such a manner that each observed zone is situated in a volume adjacent to and parallel to the bottom of the swimming pool; wherein said system further comprises at least one stationary pattern constituted of or adapted to be applied to at least one portion of the swimming pool wall adjacent said critical zones, said system being arranged to monitor said absence of bodies in danger by the permanent detection of said pattern, and to signal danger by detection of the temporary but non-transient obstruction of said permanently detected pattern.

2. A monitoring system according to claim 1, comprising means for detecting and signaling whether light rays can or cannot pass through a zone of the swimming pool to be observed, either due to the presence of a body or for any other reason affecting visibility.

3. A monitoring system according to claim 2, wherein said means for detecting the capacity of light rays to pass through the zones to be observed comprises means for detecting the limits of said zones to be observed which can be in the form of a multiplicity of light barriers having elements placed on either side of the zones to be observed, or reflection barriers having reflectors placed on the side opposite to that with the receivers.

4. A monitoring device according to claim 3, comprising light-signal emitters constituted of light projectors, or luminous strips located on the periphery of the swimming pool, or wherein the pool is illuminated by daylight.

5. A monitoring device according to claim 4, comprising light-barrier receivers concentrated at various points and provided with mechanical or electrical scanning means arranged in such a manner as to enable them to observe the desired limits of said zones.

6. A monitoring device according to claim 5, comprising light receivers constituted of video cameras associated with software adapted to process selected limiting zones.

7. A monitoring device according to claim 6, comprising means for providing various images taken at different angles which are superimposed to provide a composite image corresponding to a plan view of the swimming pool wherein bodies on the bottom appear and which serves as basis for the processing of the absence or the presence of immersed immobile bodies.

8. A monitoring device according to claim 7, comprising a device for monitoring correct functioning of the basic equipment which superimposes on the emitted rays a periodic modification of a part of these rays, and a device for controlling the result of this modification which signals any deficiency or non-perception of said modification by the basic equipment.

9. A monitoring device according to claim 8 comprising, in addition to detection means placed under the surface of the water, further detection means such as cameras placed out of the water to enable an increase of the data contributing to determining danger.

10. A monitoring device according to claim 6, comprising a central computer programmed to examine the image of each camera for a fixed time, then examine the image of the next camera, setting off an alarm if a portion of the image of the permanently observed pattern, corresponding to a minimum part of the observed pattern, is disturbed for a certain minimum time.

11. A monitoring device according to claim 6, wherein the algorithm of the image-processing software is based on four basic phases: attenuation of the background noise; pre-filtration of insignificant harmonics followed by subtraction of the background noise; contrast equalization; and the spectral selection of significant harmonics.

12. A monitoring device according to claim 11, wherein said phase of spectral selection of significant harmonics is divided into two steps: a first step which comprises selecting the absolute value of all amplitudes whose spatial frequency surrounds that resulting from an alternating arrangement of patterns, followed by a second step of classifying the selected amplitudes into a histogram from whose shape it can be determined if the signal is a periodic one or noise.

13. A monitoring device according to claim 10, wherein the algorithm of the image-processing software is based on four basic phases: attenuation of the background noise; pre-filtration of insignificant harmonics followed by subtraction of the background noise; contrast equalization; and the spectral selection of significant harmonics.

14. A monitoring device according to claim 13, wherein said phase of spectral selection of significant harmonics is divided into two steps: a first step which comprises selecting the absolute value of all amplitudes whose spatial frequency surrounds that resulting from an alternating arrangement of patterns, followed by a second step of classifying the selected amplitudes into a histogram from whose shape it can be determined if the signal is a periodic one or noise.

* * * * *